US005650778A

United States Patent [19]

Urbas et al.

[11] Patent Number: 5,650,778

[45] Date of Patent: Jul. 22, 1997

[54] ANTENNA FOR PROGRAMMING A TRANSPONDER

[75] Inventors: Donald J. Urbas, Evergreen; David Ellwood, Lakewood, both of Colo.

[73] Assignee: Bio Medic Data Systems, Inc., Maywood, N.J.

[21] Appl. No.: 497,352

[22] Filed: Jun. 30, 1995

[51] Int. Cl.[6] ..... G08C 19/06

[52] U.S. Cl. ..... 340/870.31; 340/870.16; 340/825.54; 343/873

[58] Field of Search ..... 340/870.31, 870.32, 340/870.33, 870.02, 870.16, 870.17, 825.54; 343/789, 841, 850, 851, 872, 873, 878

[56] References Cited

U.S. PATENT DOCUMENTS

| | | | |
|---|---|---|---|
| 4,464,544 | 8/1984 | Klein | 381/111 |
| 4,983,963 | 1/1991 | Hodgetts et al. | 340/870.31 |
| 5,250,944 | 10/1993 | Urbas et al. | 340/870.31 |
| 5,252,962 | 10/1993 | Urbas et al. | 340/870.17 |
| 5,359,160 | 10/1994 | Wirtz | 340/870.31 |
| 5,451,939 | 9/1995 | Price | 340/870.31 |

FOREIGN PATENT DOCUMENTS

| | | |
|---|---|---|
| 0507360A2 | 10/1992 | European Pat. Off. . |
| 499037 | 1/1939 | United Kingdom . |
| 2016150 | 9/1979 | United Kingdom . |
| WO87/04900 | 8/1987 | WIPO . |

*Primary Examiner*—Jeffery Hofsass
*Assistant Examiner*—Andrew Hill
*Attorney, Agent, or Firm*—Stroock & Stroock & Lavan LLP

[57] ABSTRACT

An antenna for programming a transponder in a partially shielded housing includes a non-metal spindle having a slot therein. The slot is adapted to receive the shielded housing containing the transponder. An exciter coil assembly is wound about the spindle so that the spindle positions the transponder relative to the exciter coil assembly so that the coil of the transponder antenna is coaxially aligned with the coil of the programming antenna.

6 Claims, 1 Drawing Sheet

ANTENNA FOR PROGRAMMING A TRANSPONDER

BACKGROUND OF THE INVENTION

This invention is directed to an antenna and a system for outputting a signal to program a passive transponder, and in particular, to an antenna for transmitting a signal to a passive transponder and receiving the signal transmitted back by the passive transponder when the transponder is shielded.

Transponder and scanner systems are well known in the art. By way of example, U.S. Pat. No. 5,250,944 discloses a system for receiving a signal from a passive transponder which includes a probe for transmitting an exciter signal having a first frequency and receiving a signal from the transponder having a second frequency. The probe includes an antenna including an exciter coil for transmitting the exciter signal. The exciter coil includes a second coil and primary coil wound about the second coil. The second coil is tuned to resonate at the first frequency. A receiver is provided for driving the primary coil at the first frequency. This system has been satisfactory, however it suffers from the deficiency that it is unable to accurately send and receive signals from a passive transponder located within a partially shielded housing such as a steel cannula utilized in tagging animals.

Passive transponders are widely used to identify animals, either as part of a livestock herd, domestic pets, or for use in laboratory experiments. A convenient way for attaching the passive transponder to the animal to inject the transponder subcutaneously into the animal utilizing a cannula. To prevent infection to the animal, the cannula and transponder are sterilized and shipped to the user as a sterilized package, the transponder being stored in an ejection ready position within the cannula. The cannula must be made of FDA approved materials such as stainless steel because of the contact with the animal tissue. Stainless steel acts as a shield to the magnetic waves which are used to program passive transponders. As a result, the transponder cannot be accurately programmed or read while in the cannula. Therefore, the prior art exciter antennas are only able to program the transponder either before the transponder is placed in the cannula or after the transponder has been ejected from the cannula into the host animal. As a result, the transponder cannot be programmed and checked prior to insertion within the animal. As a result, the user who is implanting transponders into a large number of animals cannot quickly program each of the transponders prior to insertion, rather, the user must insert the transponder within the animal then program the transponder and scan the transponder as a check for proper programming. This is a time consuming process which provides no final quality control immediately prior to insertion. Therefore, an efficient system capable of transmitting a signal for programming a transponder and receiving a signal for reading the programmed transponder while the transponder is within a partially shielded environment is provided by the instant invention.

SUMMARY OF THE INVENTION

Generally speaking, in accordance with the instant invention, an antenna assembly includes a non-metal spindle having a slot formed therein. An exciter antenna assembly is wound about the spindle coaxially with the slot. The slot is dimensioned to receive a cannula therein and position the cannula so that a transponder positioned within the cannula is disposed so that EMF forces generated by the exciter assembly are coaxial with the coil of the exciter assembly and the coil contained within the transponder.

The exciter assembly is formed of two coils, a primary coil and a secondary coil. The secondary coil is tuned to the excitement frequency of the primary coil and has a natural resonance at the excitement frequency of the primary coil. As a result, the primary coil need only be driven by a fraction of a duty cycle pulse wave allowing the resonance within the secondary coil to fully resonate for the remaining portion of the cycle providing a full cycle exciter signal. A receive coil is mounted on the spindle and disposed at a null point relative to the field generated by the exciter antenna assembly for receiving signals produced by the transponder.

Accordingly, it is an object of the invention to provide an improved system for the transmission and reception of signals to and from a passive transponder.

Another object of the invention is to provide an antenna capable of programming a transponder which is within a partially shielded environment.

Yet another object of the invention is to provide a receive antenna capable of receiving a signal transmitted by a transponder in a partially shielded environment.

Still other objects and advantages of the invention will in part be obvious and will in part be apparent from the specification.

The invention accordingly comprises the features of construction, combination of elements and arrangement of parts which will be exemplified in constructions hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF PREFERRED EMBODIMENT

Figure 1:
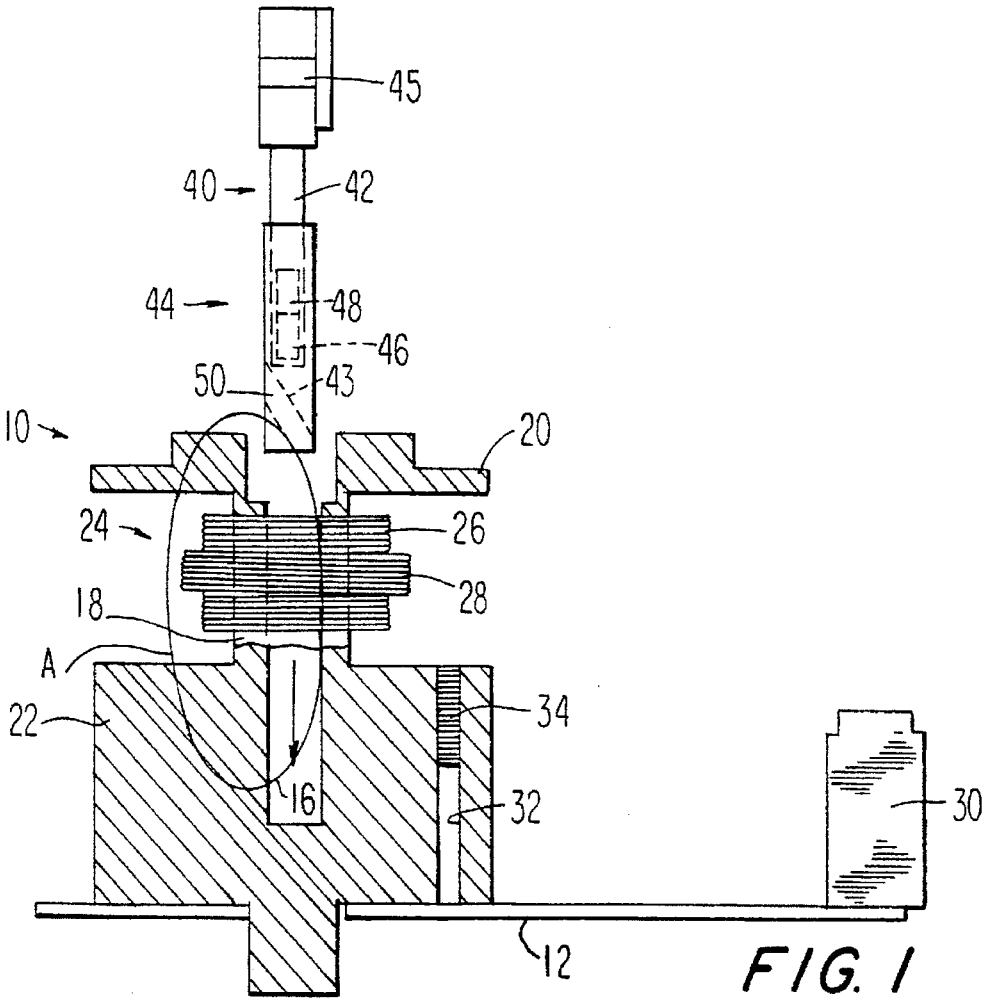
FIG. 1 is a sectional view of an antenna assembly constructed in accordance with the present invention.
Figure 2:
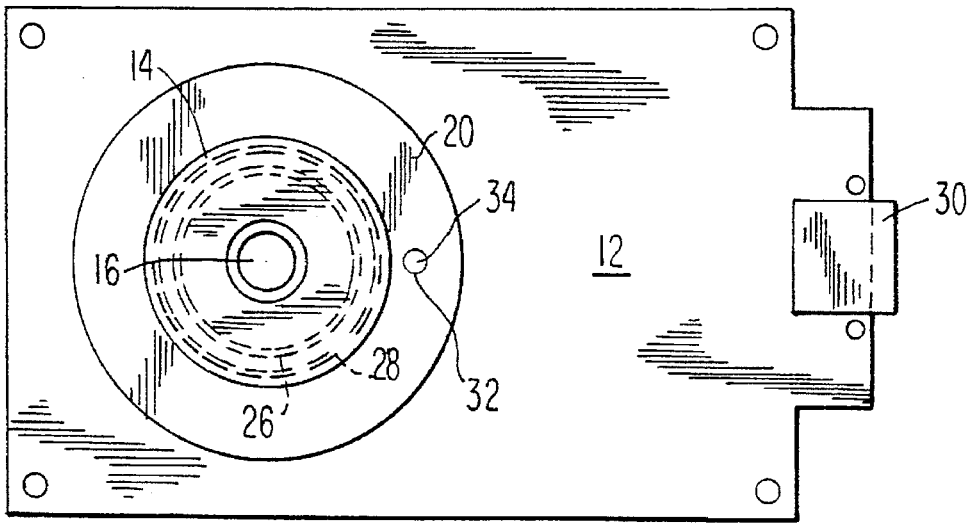
FIG. 2 is a top plan view of the antenna assembly of FIG. 1 showing the antenna coils in phantom.

Reference is made to FIGS. 1 and 2 wherein an antenna assembly generally indicated as 10 is provided. A PC board 12 supports a spindle 14. Spindle 14 is formed with a slot 16 therein. Spindle 14 is formed with a waist 18 disposed between a flange 20 and a base 22.

An exciter coil assembly, generally indicated as 24, is disposed on spindle 14 about waist 18. Exciter coil assembly 24 includes an exciter secondary coil 26 and an exciter primary coil 28. Secondary coil 26 is formed with a single wire wrapped about waist 18 to form a coil coaxial and centered with slot 16. The wire of exciter secondary coil 26 is coupled through PC board 12 to a PC board connector 30 to exciter driving circuitry which is known in the art from U.S. Pat. No. 5,250,944 and incorporated by reference as if set forth fully herein. Secondary coil 26 may be covered with a layer of electrical tape to maintain secondary coil 26 in place. Primary coil 28 is wound about secondary coil 26 to be coaxial with secondary coil 26. Exciter primary coil 28 has substantially fewer windings than exciter second coil 26 forming a two stage step up inductor.

In an exemplary embodiment, the ratio of turns of primary coil 28 to secondary coil 26 is about 1 to 17. Primary coil 28 and secondary coil 26 are formed of litz wire. Exciter secondary coil 26 is tuned to resonate at the same frequency that is output by the exciter primary coil 28. This results in inductive coupling for a transmit antenna having a very high Q. By closely tuning the resonant frequency of exciter secondary coil 26 to the output frequency of exciter primary coil 28, it tightly tunes secondary coil 26 functioning as an exciter coil with high Q. This results in an energy-saving, highly efficient magnetic field transmitter.

As a result, secondary coil 26 has a natural resonance, the exciter signal frequency to be output by exciter coil assembly 24. Primary coil 28 need only be driven by a fraction of a duty cycle pulse wave at the exciter frequency allowing the resonance with secondary coil 26 to freely resonate for the remainder of the cycle thereby providing a full cycle exciter signal. Exciter coil assembly 24 outputs a magnetic energy in a direction shown by loop A, a portion of which passes through slot 16 substantially parallel to slot 16.

A groove 32 is formed within base 22 of spindle 14. A receive coil 34 is disposed within slot 32 at a null position of the electromagnetic field produced by exciter coil assembly 24. The receive coil is wound in the same direction as the exciter coil. As a result, the exciter signal produced by exciter coil assembly 24 does not interfere with the reception of signals by receive coil 34. Receive coil 34 is a coil wound about a ferrite rod as known in the art.

A needle assembly, generally indicated as 40, includes a cannula (needle) 42 having an exit opening 43 and an entrance opening (not shown). A plastic stopper 45 is molded about the entrance opening of needle 42. A transponder 44 is disposed within cannula 42 by a tension fit. Transponder 44 includes an IC chip 48 and transponder antenna coil 46 as known in the art. A cap 50 is disposed on the exit end 43 of cannula 42. Cap 50 is dimensioned to form a tension fit with slot 16 so that slot 16 holds needle assembly 40 in place when disposed within spindle 14.

When needle assembly 40 is positioned within slot 16, the electromagnetic energy produced by exciter coil assembly 24 will be coaxial to both transponder coil 46 and exciter coil assembly 24. The exciter coil assembly is tuned with the metal needle being in the center of exciter coil assembly 24. The transponder is located within the cannula 42 held in place by the plastic cap 50 and in a tension fit with slot 16. When exciter coil assembly 24 is energized, the magnetic energy passes through the center of the inductor and through opening 43 of needle assembly 40 energizing coil 46 of transponder 44. By providing EMF lines coaxial with both the transponder coil and the exciter coils, it is possible to program a transponder with the shielding of a cannula.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter language might be said to fall therebetween.

What is claimed is:

1. An antenna assembly for programming a passive transponder including a transponder antenna coil in a partially shielded housing, comprising: a spindle; an exciter coil assembly including at least a first coil mounted about said spindle; and said spindle having a slot therein adapted to receive said partially shielded housing for positioning said transponder antenna coil within said spindle so that said transponder antenna coil is coaxially aligned within said exciter coil assembly.

2. The antenna assembly of claim 1, wherein said exciter coil assembly includes a secondary coil wound about said spindle and a primary coil wound about said secondary coil.

3. The antenna assembly of claim 1, wherein said spindle is made of a non-metal material.

4. The antenna assembly of claim 1, further comprising a receive coil, said receive coil being disposed on said spindle at a null position relative to said exciter coil assembly.

5. An antenna assembly for programming a passive transponder including a transponder antenna coil in a partially shielded housing comprising: a spindle; an exciter coil assembly including at least a first coil mounted about said spindle; said spindle having a slot therein adapted to receive said partially shielded housing and being made of a non-metal material and said slot being adapted for positioning said transponder within said spindle so that said transponder antenna coil is coaxially aligned within said exciter coil assembly; said exciter coil assembly including a secondary coil wound about said spindle and a primary coil wound about said secondary coil; and a receive coil, said receive coil being disposed on said spindle at a null position relative to said exciter coil assembly.

6. A method for programing a transponder having a transponder antenna coil when the transponder is placed within a partially shielded housing comprising the steps of placing said transponder within a programming antenna assembly, the programming antenna assembly having at least a first coil, and orienting the partially shielded housing within the programming antenna assembly so that the transponder antenna coil is coaxially aligned within the first coil of the programming antenna assembly.

* * * * *